United States Patent [19]

Denzler

[11] Patent Number: 4,920,776

[45] Date of Patent: May 1, 1990

[54] PROCESS AND APPARATUS FOR THE INTERMITTENT STRAIGHTENING OF WIRE

[75] Inventor: Emil Denzler, Wuerenlos, Switzerland

[73] Assignee: H. A. Schlatter AG., Schlieren, Switzerland

[21] Appl. No.: 242,912

[22] Filed: Sep. 12, 1988

[30] Foreign Application Priority Data

Oct. 1, 1987 [CH] Switzerland ..... 3819/87

[51] Int. Cl.[5] ..... B21D 3/00; B21F 1/02

[52] U.S. Cl. ..... 72/79; 140/139

[58] Field of Search ..... 72/72, 79, 131; 140/139, 140

[56] References Cited

U.S. PATENT DOCUMENTS

| | | | |
|---|---|---|---|
| 1,313,024 | 8/1919 | Shuster | 72/72 |
| 1,925,845 | 9/1933 | Moore | 140/140 |
| 2,791,243 | 5/1957 | Paulson | 72/79 |
| 2,965,150 | 12/1960 | Hunter | 72/79 |
| 4,046,177 | 9/1977 | Louis et al. | 72/79 |
| 4,610,281 | 9/1986 | Fuchs et al. | 140/139 |

FOREIGN PATENT DOCUMENTS

| | | | |
|---|---|---|---|
| 1125894 | 11/1956 | France | 72/79 |
| 497457 | 11/1955 | Italy | 72/79 |

*Primary Examiner*—Robert L. Spruill

*Attorney, Agent, or Firm*—Brady, O'Boyle & Gates

[57] ABSTRACT

The intermittent straightening of the wire (1) is carried out by means of a fixedly supported straightening rotor (4), the straightening blocks (5, 6, 7) of which radially deflect the wire (1) advanced by conveying mechanism (2). The mass moment of inertia of the straightening rotor (4) is dimensioned to be so small that the straightening rotor (4) can be decelerated and accelerated at least approximately within the same time period as the wire (1) by the conveying mechanism (2). For cutting to length, the straightening rotor (4) is braked in synchronism with the wire (1) and thereafter again accelerated. Thereby, a perfect wire quality is achieved, in particular a uniform elongation approximately constant over the entire length of the wire, without having to move the cutting device at the high wire feeding speed, or without having to move the straightening rotor axially or the straightening blocks radially, in order to avoid heating up and damaging of the arrested wire by the further operating straightening rotor. Different straightening rotors (4) are utilized for different wire types, these rotors being easily exchangeable with their bearings (46).

18 Claims, 4 Drawing Sheets

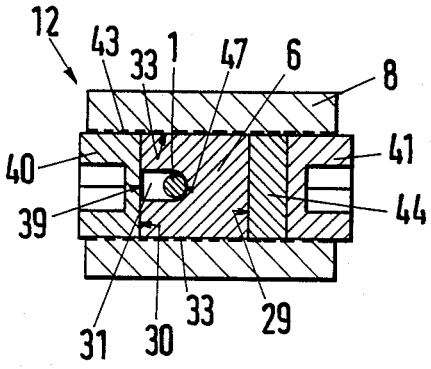
Fig. 4
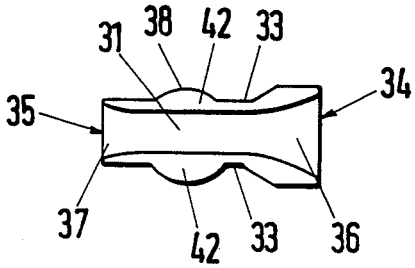
Fig. 5
Fig. 6
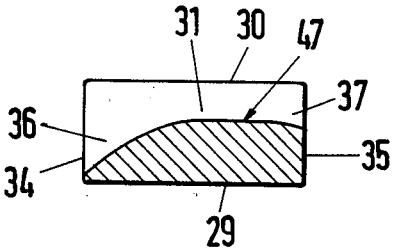
Fig. 7
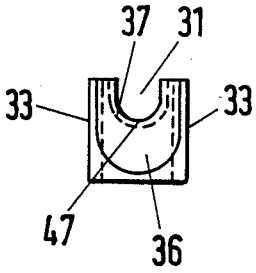

PROCESS AND APPARATUS FOR THE INTERMITTENT STRAIGHTENING OF WIRE

The invention relates to a process for the intermittent straightening of wire and to an apparatus for performing the process.

BACKGROUND OF THE INVENTION

Processes of this type are to be distinguished from those wherein the wire is advanced with unretarded feeding speed also during the operation following the straightening step, especially a cutting procedure that follows straightening, and therefore the operating means performing the operation subsequently to the straightening step, e.g. a cutter for cutting the wire to length, must be moved along with the high feeding speed together with the wire. These processes, known, for example, from U.S. A-1,703,885, although exhibiting the advantage that the problem of heating up and damage (burning through, embrittlement, inhomogeneous strength of material) to the stationary wire in the rotating straightening rotor is obviated, but they have the drawback that the operating means moving along at the high wire feeding speed, e.g. the cutter designed as so-called "flying shears", is complicated in its structure and expensive. Japanese Patent No. A-58 122 139 also discloses a process of that other type wherein the wire continues to travel at an invariably high feeding speed, rather than intermittently, also during the subsequent operation. The wire straightening device known therefrom comprises several groups of conveying rollers for feeding the wire, adjustable shaping rollers, a straightening rotor with a cylindrical housing wherein three straightening blocks are arranged, and a wire scanning device checking the linearity of the straightened wire. An adjusting device is located in the housing of the straightening rotor, for the radial adjustment of the straightening blocks; this device can be connected, with the straightening rotor standing in a specific rotational position, by way of a clutch with a motor which latter can be displaced by a shifting device. The wire feeding speed and the angular velocity of the straightening rotor are calculated and set by a control device based on the wire diameter and the wire material. The straightening rotor can be connected selectively (apparently by way of a freewheel clutch) with an electric motor generating the angular velocity for the straightening step and with a stepping motor for rotating the rotor into the rotational position for setting the straightening blocks; the stepping motor is activated by the control device after the straightening rotor has ceased turning with the electric motor being stopped. Straightening here is interrupted only if a new wire having different properties is to be used, requiring a different setting of the straightening blocks.

The process of this type is also to be distinguished from those processes of another type wherein the wire is stopped during the procedure, especially during the cutting step, and the straightening rotor, with the wire being stationary, is moved in the axial direction (longitudinal direction of the wire) in order to prevent excessive squeezing work at one point and thus embrittlement or burning through of the wire. A process and apparatus of that other type has been known from U.S. A-2,172,134. In this reference, the straightening rotor is supported on a carriage movable to and fro on a pair of rods and is driven by way of a clutch. The carriage is respectively moved forwards during wire feed with the rotating straightening rotor and backwards with the rotating straightening rotor with the wire being stationary for cutting, clamped fixedly by means of grippers. At the end of the backward movement, the carriage abuts against a stop whereby the clutch is disengaged and the straightening rotor is allowed to run out. After cutting the wire to length, the grippers are opened and the carriage again moved forwards, the clutch being engaged and the wire piece, previously straightened during the backward travel of the carriage, moving through the grippers.

The complicated and trouble-prone, very rapid movement of the operating means, e.g. the so-called flying shears, and the movement of the straightening rotor in the wire direction (in the direction of the axis of the straightening rotor) is eliminated in the process of this type known from Swiss A-475,806. In this arrangement, the wire is cut off while standing still, and the straightening blocks of the rotating straightening rotor are moved during the period of standstill of the wire by hydraulic or pneumatic means radially in such a way that the squeezing work is reduced and thus embrittlement and burning through of the wire are prevented. Also the radial adjustment of the straightening blocks of the rotating straightening rotor is, however, complicated and susceptible to disturbances.

SUMMARY OF THE INVENTION

The invention is based on the object of providing a process and apparatus of the type discussed hereinabove which work in a simple, troublefree manner and at a high production rate and ensure a perfect, uniform wire quality homogeneous over the entire length of the wire (strength, uniform elongation, etc.).

A perfect wire quality homogeneous over the entire length of the wire is obtained by the synchronous retardation of the rotation of the straightening rotor and of the wire feed before the operation, as well as by the synchronous acceleration after the operation: The properties of the material of the wire are homogeneously altered by the straightening process of this invention in the longitudinal direction of the wire, and the straightened wire retains a strength and uniform elongation, in particular, which are approximately constant over its entire length, i.e. especially the wire section traveling first with delayed and then again accelerated feed through the likewise initially retarded and then again accelerated straightening rotor also has imparted thereto the same, or at least almost the same, strength and uniform elongation as the remaining wire traveling at constant feeding speed through the rotating straightening rotor revolving at constant angular velocity.

The invention eliminates the drawbacks that have to be tolerated in the state of the art, namely the very rapid movement of the operating means in the longitudinal direction of the wire (U.S. A-1,703,885); the to and fro movement of the straightening rotor in the direction of the rotor axis during standstill of the wire (U.S. A-2,172,134); and, respectively, the radial shifting of the straightening blocks during cessation of wire feed (Swiss A-475,806) for the purpose of reducing the heating up and damaging of the stationary wire by the further rotation of the straightening rotor. These disadvantages were tolerated in the state of the art because experts in the field heretofore harbored the opinion (cf., for example, Swiss A-475,806) that braking of the straightening rotor upon cessation of wire feed could not be executed within the time period still economically feasible for an intermittent straightening process, on account of the design of the straightening rotor and of the straightening blocks, which necessarily must be solid in view of the great forces and the high wear and tear (compare the straightening rotors shown in the aforementioned references, as well as in U.S. A-1,594,570 and U.S. A-2,965,150).

The novel route along which the invention proceeds, namely the synchronous retardation and acceleration of the straightening rotor with the wire, is made possible with respect to the structure of the apparatus in that the angular momentum of the straightening rotor is dimensioned so small that the latter can be retarded and accelerated at least approximately within the same time period as the wire by the conveying means. This teaching in connection with the apparatus, is surprising as compared with the state of the art.

The process of this invention can basically be performed in the two modes of operation set forth below. In the first embodiment, the wire is delayed to a reduced feeding speed, and the straightening rotor is braked to a reduced angular velocity, and at the reduced feeding speed the operating means, especially the cutter, are moved along synchronously with the wire. After cutting to length, the wire and the straightening rotor are again accelerated and the operating means or the cutter returns into its initial position in order to be ready for the subsequent cutting step. In the second embodiment, the wire is decelerated to complete standstill, and the straightening rotor is retarded either likewise to complete standstill or to such a low angular velocity that no impairment of wire quality occurs. The operation or the step of cutting to length, following the straightening step, takes place in this case during standstill of the wire with fixedly arranged and/or mounted operating means and/or with a fixedly located cutter.

Both embodiments have optimum areas of usage. The first embodiment is more complicated structurally than the second embodiment, but, as a compensating feature, permits higher production rates. For the first embodiment, a cutting device can be utilized designed in the manner of the cutter (so-called "flying shears") known U.S. A-1,703,885 wherein the expenditure for construction and the susceptibility to trouble are substantially lower on account of the retarded wire feeding speed.

Both embodiments can be optimally adapted to the cycle times of subsequent and preceding groups of machines.

BRIEF DESCRIPTION OF THE DRAWINGS

The invention will be described in greater detail with reference to the drawings appended hereto, showing merely one exemplary mode of operation. In the drawings:

FIG. 4 is a cross section through the straightening rotor along line IV—IV in FIG. 1, FIG. 5 is a top view of one of the straightening blocks of the straightening rotor, FIG. 6 is a longitudinal section through the straightening block, FIG. 7 is an end view of the straightening block.

DESCRIPTION OF THE PREFERRED EMBODIMENTS

Figure 1:
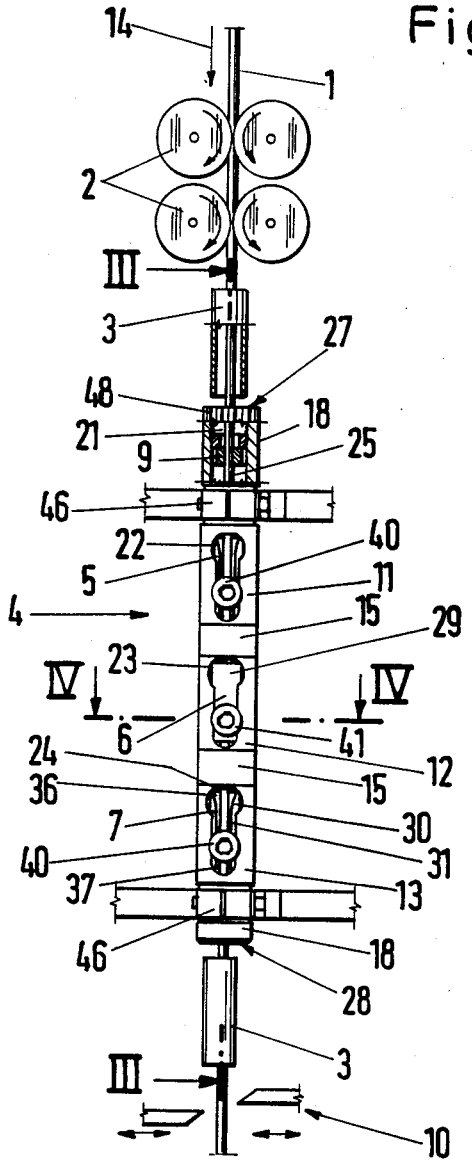
FIG. 1 is a top view of part of a wire straightening and cutting machine.
Figure 2:
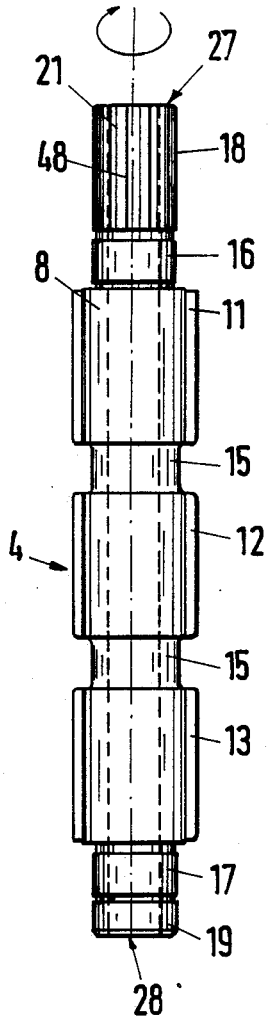
FIG. 2 is a lateral view of the straightening rotor of the machine according to FIG. 1.
Figure 3:
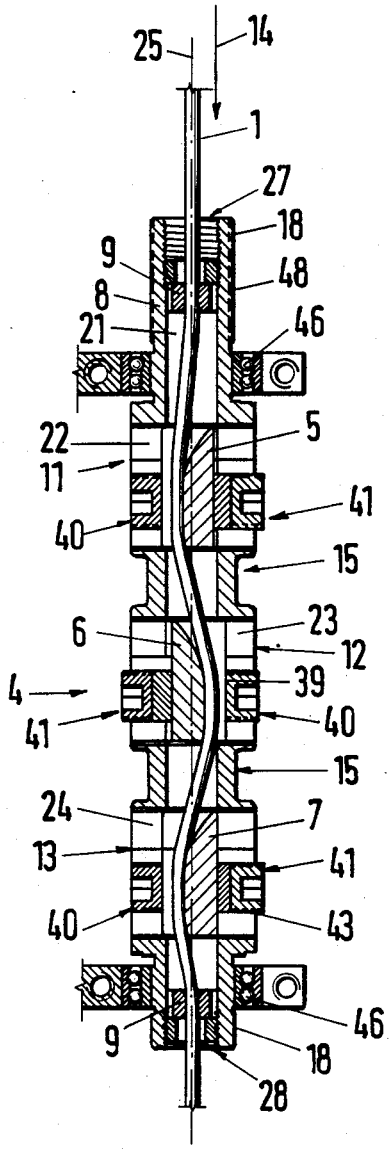
FIG. 3 is a longitudinal section through the straightening rotor along line III—III in FIG. 1.

The apparatus for straightening and cutting to length the wire 1 has two pairs of rolls 2 for the acceleration, uniform moving, and braking of the wire 1, a stationary cutting device 10 for cutting the wire 1 during standstill, and respectively one guide tube 3 upstream and downstream of the straightening rotor 4 with rotor body 8. The rotor body 8 houses three straightening blocks 5, 6, 7 with respectively one balancing weight 44 and respectively two headless screws 40, 41, as well as respectively one guide bushing 9 upstream and downstream of the three straightening blocks 5, 6, 7. The rotor body 8 is a one-piece structural element with three block-shaped sections 11, 12, 13 of equal length and with two circular-cylindrical regions 15 lying between these sections 11, 12, 13, as well as respectively one circular-cylindrical shoulder 16, 17 for supporting purposes and respectively one hollow-cylindrical piece 18, 19 for fixedly mounting respectively one guide bushing 9. The axes of the circular-cylindrical shoulders 16, 17, of the hollow-cylindrical pieces 18, 19, of the two circular-cylindrical zones 15, and the diagonal intersection points of the end faces of the right-parallel piped sections 11, 12, 13 lie on the geometric axis of rotation 25 of the straightening rotor 4. The axis of rotation 25 is also the axis of a cylindrical bore 21 located in the rotor body 8, the diameter of this bore being given by the wall thickness of the circular-cylindrical regions 15 governing for the ruggedness of the entire straightening rotor 4. The outer diameter of the circular-cylindrical regions 15 is as large as the small side of the end face of the block sections 11, 12, 13. Three milled recesses 22, 23, 24 with clearance fittings for the straightening blocks 5, 6, 7 are arranged perpendicularly to the small side of the block-shaped sections 11, 12, 13. The aforedescribed structure of the rotor body 8 is chosen so that minimum mass moment of inertia is obtained.

The wire 1 to be straightened, conveyed through the pairs of rolls 2 in the direction of arrow 14, enters the straightening rotor 4 in the axis of rotation 25 at the front end face 27, is retained in the hollow-cylindrical piece 18 in the axis of rotation 25 by the guide bushing 9, and is conducted through the straightening blocks 5, 6, 7, and leaves the straightening rotor 4 again at its rearward end face 28 through the guide bushing 9 in the hollow-cylindrical piece 19.

The straightening blocks 5, 6, 7 exhibit a planar, solid underside 29 and a groove 31 opening toward the topside 30 of the straightening blocks 5, 6, 7. The groove 31 extends in the center of the topside 30 of the straightening blocks 5, 6, 7 and is in its width larger by a tolerance than the wire diameter. The depth of the groove 31 is so large in its unwidened portion that it completely accommodates the wire to be straightened. From the planar underside 29, the two sidewalls 33, as well as the end faces 34, 35, extend vertically upwardly. Toward the forward end face 34, the groove 31 flares in a funnel shape 36, approximately to twice the width of the original size of the groove whereas the rearward termination has a widening 37 of merely about 20% and amounts to approximately 10% of the total length of the straightening rotor 5, 6, 7. The depth of the unwidened groove 31 amounts to about 40% of the height of the straightening block 5, 6, 7, respectively. As a consequence, the angular momentum of the rotor is only insubstantially increased by the straightening blocks. The straightening blocks 5, 6, 7 have the same height over their entire length. The width of the rearward end face 35 amounts to two-thirds of the forward end face 34. The forward end face 34 and the rearward end face 35 lie in parallel to each other and perpendicularly to the axis of the groove 31. Directly adjacent the point of widening for the forward groove funnel 36 in the direction toward the rearward termination, the straightening block 5, 6, 7 respectively, has a circular bulge 38 on the topside 30, the diameter of this bulge being about 10% smaller than the width of the forward end face 34, and this bulge extending along the two longitudinal sides 33 up to the underside 29. The circular bulge 38 in the straightening blocks 5, 6, 7 is located in the point of force application of the deflected wire 1. The diameter of the bulge 38 is chosen to be so large that the bulge 38, on the one hand, slides in the milled-out portion 22, 23, 24 by the clearance fitting with thread 43 for the headless screws 40, 41 and, on the other hand, the smooth, solid bottom 39 of the headless screw 40 has a satisfactory supporting surface 42. As in case of the straightening rotor 4, attention has been given to minimum weight also in case of the straightening blocks 5, 6, 7. For this reason, the sidewalls 33, in the zone of the top rim of the groove 31 outside of the bulge 38, have a width of merely a fraction, preferably one-third, of the groove 31.

The position of the milled recesses 22, 23, 24 for the straightening blocks 5, 6, 7 and the guide bushings 9, as well as their dimensions, depend on the mechanical data displayed by the wire 1 to be straightened. The milled recesses 22, 23, 24 are fashioned as clearance fittings for the straightening blocks 5, 6, 7 and exhibit a thread 43 in the portion receiving the bulge 38 of the straightening blocks 5, 6, 7. The straightening block 5, 6, 7, respectively, is held in its position by two headless screws 40, 41 above and below the straightening blocks 5, 6, 7 in the thread 43. The forward and rearward straightening blocks 5 and 7 deflect the wire 1 into a direction out of the axis of rotation 25 while the central straightening block 6 deflects the wire in a direction opposite thereto. The grooves 31 of the straightening blocks 5, 6, 7 are open in the direction of their offsetting from the axis of rotation 25, the straightening blocks 5, 7 being offset in the same radial direction and the straightening block 6 being offset in opposition to the axis. By the offsetting of the straightening blocks 5, 6, 7, the squeezing work necessary for straightening the wire 1 during the rotation of the straightening rotor 4 and the concomitant relaxation of the wire material are attained. Since the straightening blocks 5 and 7 are offset in one direction, and the straightening block 6 is offset in the opposite direction with respect to the axis 25, a uniform mass distribution can be achieved by arranging the straightening block 6 at a correspondingly greater distance removed from the axis 25 than the straightening blocks 5 and 7. A small unbalance that may be produced on account of nonuniform wear or due to another arrangement of the straightening blocks required by special wire properties can be compensated for by respectively one counterweight 44 located in the thread 43 of the milled recesses 23. The mutual spacing of the straightening blocks 5, 6, 7 is smaller than their own length. The outer diameter of the parts of the straightening rotor 4 which do not hold straightening blocks 5, 6, 7 is reduced to the dimension solely necessary for mechanical stability, in order to reduce the total moment of inertia. Openings between the straightening blocks 5, 6, 7, as provided in conventional straightening rotors to remove broken wire, have been intentionally omitted. In case of wire breakage, the entire straightening rotor 4 can be readily exchanged.

The straightening rotor 4 is optimized with its straightening blocks 5, 6, 7 and guide bushings 9 to a wire diameter and/or wire type, and can be exchanged in its mounting 46 as an entire unit.

The headless screws 40, 41 serve for setting the straightening blocks 5, 6, 7 to optimum straightening effect on the wire 1. The wire 1, coming from a wire reservoir, normally a wire reel, not shown, is accelerated by the two pairs of rolls 2 to the feeding speed for purposes of straightening and cutting to length, and is pushed through the guide tube 3, arranged coaxially to the wire 1, into the straightening rotor 4 and is conducted to the cutter 10 by means of a further guide tube 3 arranged subsequently to the straightening rotor 4.

During the threading of the wire 1 into the straightening rotor 4, the wire is guided by way of the forward guide bushing 9 to the forward funnel 36 of the first straightening block 5. Deflection of the wire 1 to the subsequent straightening block 6, 7 and, respectively, to the guide bushing 9 in the proximity of the rearward end face 35 of the straightening rotor 4 is achieved by the smooth bottom 39 of the headless screw 40. Threading into the subsequent straightening block 6 and 7, respectively, takes place in each case through the forward funnel 36 of the respective straightening block 6, 7. During operation, the wire 1 merely travels furthermore over the groove bottom 47 of the straightening blocks 5, 6, 7.

The large forward funnel 36 of each straightening block 5, 6, 7 is required primarily only during threading of the wire, whereas the smaller rearward funnel 35, as well as the portion of the forward funnel 36 directly adjoining the point of force application, guide the wire in the groove 31 during operation.

Figure 8:
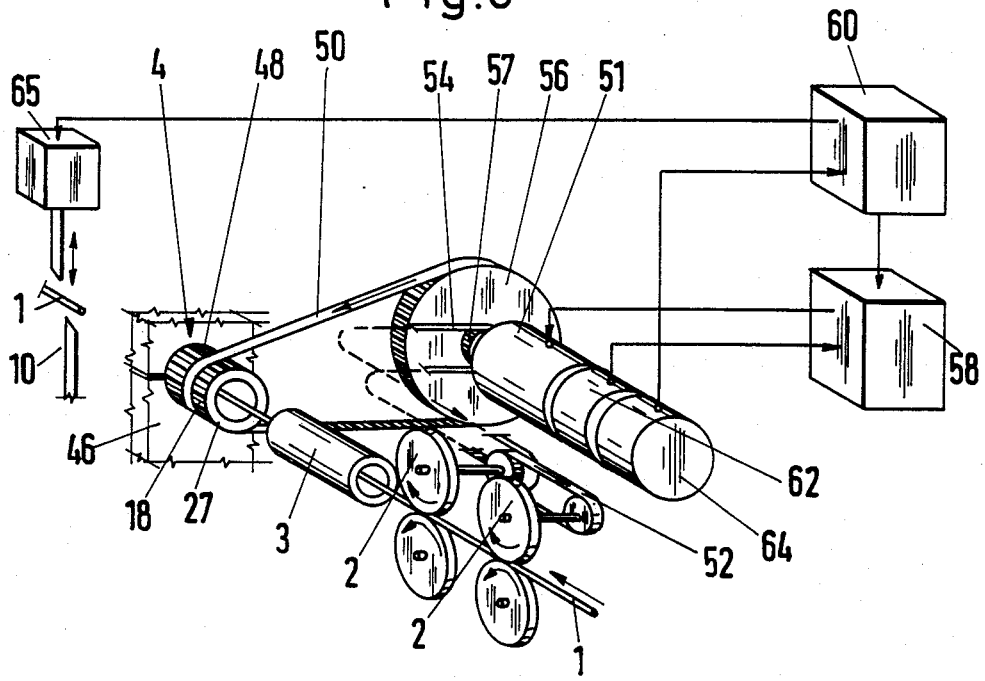
FIG. 8 is a schematic view of the control device and of the drive means of the machine according to FIG. 1.

As shown in FIG. 8, the straightening rotor 4 is driven by a dc motor 51 by way of a toothed belt 50 meshing with the hollow-cylindrical piece 18 of the forward end part 27 of the rotor 4, this piece being designed as a toothed-belt wheel 48. The upper rolls or wheels of the roll pairs 2 are coupled together by a toothed belt 52 and are driven jointly by way of a toothed belt 54 likewise by the dc motor 51. Two toothed-belt pulleys 56, 57 of differing diameters are seated on the output shaft of the dc motor 51 and mesh with the toothed belts 50, 54, the transmission ratios being dimensioned so that the straightening rotor 4 revolves at a higher angular velocity than the pairs of rolls 2. The dc motor 51 is supplied by a servo amplifier 58 with a controller (PID proportional integral differential controller) operated by a regulating means 60 (NC numerical control or CNC computer numerical control), this controller controlling and regulating the current based on the desired values supplied by the regulating device 60 in chronological succession and on the actual values of the angular velocity of the output shaft of the motor 51 measured by a tachometer 62. The respectively advanced wire length is determined by the regulating device 60 by means of an incremental transducer (incremental rotation pickup) 64 arranged on the output shaft of the motor 51. (The actual value of the angular velocity can also be determined by means of the incremental transducer 64, the tachometer 62 being eliminated.)

By virtue of the above-indicated construction of the straightening rotor 4 with the straightening blocks 5, 6, 7 and guide bushings 9, the total mass moment of inertia of the straightening rotor 4 effective during rotation is dimensioned to be so small that the rotor can be decelerated and accelerated in the same time period as the wire 1 with the roll pairs 2. The cutter 10 and the drive means 48, 50–52, 54, and 56–58 of the pairs of rolls 2 and of the straightening rotor 4 are controlled by the regulating means 60 in such a way that, in each case prior to activation of the cutter 10, the pairs of rolls 2 and the straightening rotor 4 are synchronously retarded together up to standstill, and thereafter are synchronously accelerated together; during these steps, on account of the joint drive of the straightening rotor 4 and of the pairs of rolls 2 (with differing transmission), the angular velocity of the straightening rotor 4 is raised and, respectively, reduced proportionally to the feeding speed of the wire 1.

Figure 9:
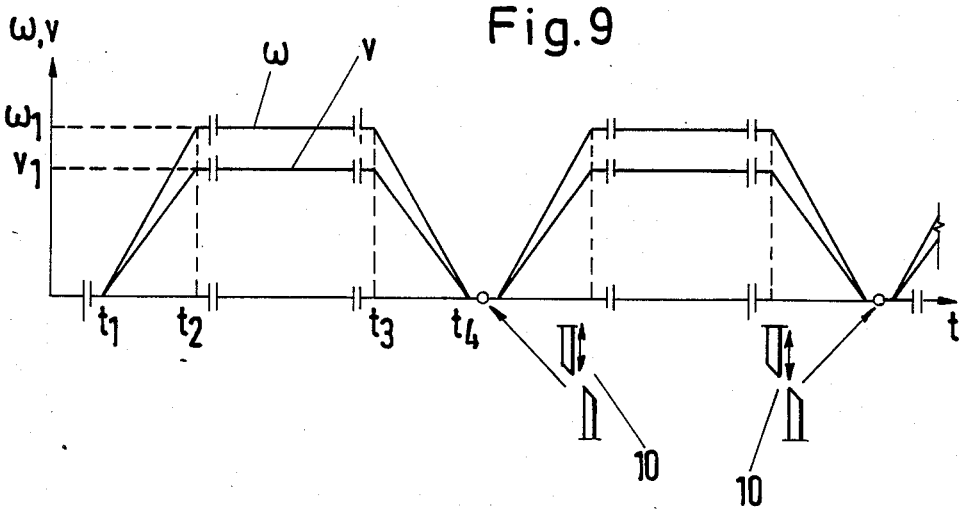
FIG. 9 is a schematic diagram of the wire feeding speed and the angular velocity of the straightening rotor in dependence on time.

The operating cycle for the straightening and cutting to length of the wire 1, regulated by the regulating device 60 and controlled by the controller, consists of three phases explained in greater detail below with reference to FIG. 9, the ratio of angular velocity of the straightening rotor 4 to the feeding velocity of the wire 1 produced by the drive rolls 2 being constant on account of the joint drive action. The ratio can be varied for differing types of wire by exchanging the toothed-belt pulleys, or, in a deviation from FIG. 8, two independent drive mechanisms can be provided for driving the straightening rotor 4 and the drive rolls 2, the controllers of which are regulated jointly by the regulating means 60 so that the ratio can be set by the control device in dependence on the type of wire at a fixed value, or optionally also in dependence on the velocity.

In the first phase starting at $t_1$, the wire 1 and the straightening rotor 4 are accelerated from standstill to a predetermined feeding and angular velocity $v_1$, $w_1$, the angular velocity w of the straightening rotor 4 being raised synchronously and proportionally to the feeding speed v. In the subsequent second phase starting at $t_2$, the wire 1 and the straightening rotor 4 are further moved at a constant velocity $v_1$, $w_1$, and in the third phase beginning at $t_3$, the wire 1 and the straightening rotor 4 are braked to standstill by decelerating the number of revolutions of the motor 51, the motor 51 operating as a braking device regulated and controlled by the regulating means 60 and the controller, and the angular velocity of the straightening rotor 4 being reduced in correspondence with the first phase in synchronism and proportionally to the feeding speed of the wire 1. After the standstill of the wire 1 achieved at $t_4$, the driver 65 of the fixedly arranged cutter 10 is activated by the regulating device 60 and the wire 1 is cut to length, whereupon the next cycle starts with the first phase of synchronous acceleration of straightening rotor 4 and wire 1.

The feeding speed $v_1$ can be, for example, 2–5 m/sec, and the angular velocity $w_1$ can be chosen so that the straightening rotor, with a wire feed of 5–25 mm, executes one revolution, so that the angular velocity $w_1$ thus amounts to, for example, 12,000 rpm. In the embodiment shown in the drawings, the acceleration time $t_2-t_1$ required in the first phase for accelerating the straightening rotor 4 from standstill to $w_1=12{,}000$ rpm amounted to 0.1–0.2 sec. Correspondingly short, i.e. merely one to two tenths of a second, was the retardation period $t_4-t_3$ for decelerating the straightening rotor 4 (and the wire 1) from the angular velocity $w_1$ to standstill. The extremely brief accelerating and decelerating time is obtained thanks to the extremely low mass moment of inertia of the straightening rotor 4 achieved by the above-indicated structure, this mass moment of inertia being smaller by two orders of magnitude (about a hundred times) than that of conventional straightening rotors.

In case of wire sections to be cut to length at extremely short operating cycles in the tenth of a second range, and, respectively, with very short lengths (in the centimeter range), the second phase of uniform movement can be eliminated, i.e. the wire 1 and the straightening rotor 4 can be accelerated and again decelerated in immediate succession. If machines or groups of machines in a production line located upstream or downstream of the wire straightening and cutting machine exhibit a longer operating cycle, then a waiting cycle can be added following the cutting to length of the wire 1 after which the operation is then again continued with the first movement phase.

In place of the step of cutting to length, other operations are also possible, such as, for example, bending of the wire, welding a cross wire thereto, and the like.

In place of the two roll pairs 2 upstream of the straightening rotor 4 for insertion of the wire 1, it is also possible to arrange respectively one pair of rolls 2 before and one pair behind the straightening rotor 4, or it is also possible to merely provide pairs of rolls which pull the wire 1 through the rotor 4. The arrangement to be selected depends on the wire data and the required straightening qualities. In general, however, pulling rolls 2 downstream of the straightening rotor 4 will impair the straightening quality of the wire 1.

The straightening rotor (and possibly also the conveying means) can be driven hydraulically instead of by an electric motor; in this arrangement, the hydraulic fluid can simultaneously be utilized for cooling the rotor.

As a modification, the headless screw 41 engaging on the underside 29 of the straightening blocks 5, 6, 7 can be replaced by a spring arranged in the milled recess.

For continuous operation, several exchangeable straightening rotors 4 are provided. The straightening rotor 4 is removed as a unit with its two bearings from the two bearing holders 46 fixed in place by means of respectively two screws. Each of the straightening rotors 4 is tailored to the respective type of wire to be straightened, by a corresponding dimensioning of the straightening blocks and guide bushings 9, as well as their positioning in the straightening rotor 4.

Instead of decelerating the movement of the wire 1 and the rotational velocity of the straightening rotor 8 in the third movement phase to standstill, it is also possible to continue operation at reduced speed, and the wire 1 can be cut off by means of a cutter moved along in the feeding direction of the wire. In contrast to conventional processes wherein cutting to length is performed at full operating speed, it is here possible to cut to length at the speed that is at an optimum for the respective cutting device. The advantage of this version as compared with the above-described cutting to length during standstill is that a higher piece number of cut-to-length wire sections can be attained per unit time. Since the cutting device is moved along only at the reduced feeding speed, the acceleration problems of the cutting device ("flying shears") encountered in the conventional processes are eliminated.

I claim:

1. Process for the intermittent straightening of wire (1) comprising the steps of accelerating the wire (1) to a feeding speed, radially deflecting the wire by a group of straightening blocks (5, 6, 7) of a fixedly mounted straightening rotor (4) while simultaneously rotating the straightening rotor at an angular velocity, decelerating the wire from the feeding speed for a subsequent operation on the wire, and decelerating the rotation of the straightening rotor (4) in synchronism with the decelerating of the wire from the feeding speed prior to the subsequent operation, and thereafter again accelerating the rotation of the straightening rotor.

2. Process according to claim 1, in which during the decelerating step the wire (1) is decelerated to a reduced feeding speed and the straightening rotor (4) is synchronously decelerated to a reduced angular velocity, and moving a device (10) for performing the subsequent operation on the wire, concomitantly with the wire (1) at the reduced feeding speed and performing the subsequent operation on the wire with said device and, after the step of performing the subsequent operation moving the device (10) back into its initial position.

3. Process according to claim 1, wherein during the decelerating step the wire (1) is decelerated at least approximately to standstill for the subsequent operation on the wire, performing the subsequent operation on the wire at wire approximate standstill with fixedly located operating means, and the rotation of the straightening rotor (4) is decelerated at least approximately to standstill in synchronism with the decelerating of the wire to at least approximately standstill.

4. Process according to claim 1, including the steps of guiding the wire (1) upstream and downstream of the group of straightening blocks (5, 6, 7) by means of at least respectively one guide means (9) on the axis of rotation (25) of the straightening blocks 5, 6, 7).

5. Process according to claim 1, wherein during accelerating and decelerating the rotations of the straightening rotor the angular velocity of the straightening rotor (4) is increased and, respectively, decreased at least approximately proportionally to the accelerating and decelerating of the wire to and from the feeding speed of the wire (1), respectively.

6. Process according to claim 1, including after the steps of accelerating the wire to a feeding speed and accelerating the rotation of the straightening rotor to an angular velocity, the steps of maintaining the wire at the uniform feeding speed for a period of time, and maintaining the rotation of the straightening rotor at an at least approximately proportional uniform angular velocity for the same period of time that the uniform feeding speed of the wire is maintained.

7. Process according to claim 6, including adjusting the sum total of the time periods for accelerating the wire and straightening rotor, maintaining the feeding speed and angular velocity of the wire and straightening rotor, decelerating the wire and straightening rotor, and the time period between the decelerating steps and the subsequent accelerating of the wire and straightening rotor during which the subsequent operation on the wire is performed, to adapt to the cycle times of other machines used in combination with the process.

8. Process according to claim 1, including adjusting the sum total of the time periods for accelerating the wire and straightening rotor, decelerating the wire and straightening rotor, and the time period between the decelerating steps and the subsequent accelerating of the wire and straightening rotor during which the subsequent operation on the wire is performed, to adapt to the cycle times of other machines used in combination with the process.

9. Process according to claim 1, including providing said straightening rotor with a mass moment of inertia so small that the accelerating and decelerating of the straightening rotor is accomplished in approximately the same periods of time as the respective accelerating and decelerating of the wire.

10. Apparatus for straightening wire, comprising conveying means (2) for advancing a wire (1) to be straightened, a straightening rotor (4) having a longitudinal axis (25), a wire receiving passage therethrough along said longitudinal axis, and a group of wire straightening blocks (5, 6, 7) intersecting said wire receiving passage, and having a small mass moment of inertia, said straightening rotor having an input end and an output end.

support means (46) fixedly supporting said straightening rotor (4) for rotation about said longitudinal axis (25), operating means (10, 65) connected adjacent the output end of said straightening rotor disposed in alignment with said longitudinal axis (25) adapted for performing an operation on the wire (1) exiting from said output end, said conveying means (2) disposed along said longitudinal axis (25) and adapted to advance a wire through said wire receiving passage of said straightening rotor from said input end to said output end and to said operating means (10, 65), driving means (48, 50–52, 54 and 56–58) connected to said conveying means (2) and said straightening rotor (4) and operative to accelerate and decelerate said conveying means (2), and to synchronously accelerate and decelerate rotation of said straightening rotor (4) about said longitudinal axis (25), a control unit (60) connected to said driving means to operatively control the acceleration and deceleration of said driving means (48, 50–52, 54 and 56–58), and connected to said operation means (10, 65) to activate the latter, said mass moment of inertia of said straightening rotor (4) being dimensioned so small that the straightening rotor (4) is decelerated and accelerated substantially at the same rate as, and in synchronism with the deceleration and acceleration of said conveying means (2) by said driving means (48, 50–52, 54 and 56–58) when decelerated and accelerated, respectively, and said control unit (60) being operative to decelerate said driving means prior to each activation of said operating means (10, 65) and to accelerate said driving means after activation of said operating means (10, 65).

11. Apparatus according to claim 10, in which said straightening rotor (4) having, upstream and downstream of the group of straightening blocks (5, 6, 7), at least one exchangeable guide bushing (9).

12. Apparatus according to claim 11, in which said support means includes a pair of support bearings (46)

connected to said straightening rotor (4) adjacent said input end and said output end, and the straightening rotor (4) comprising an exchangeable module with said straightening blocks (5, 6, 7), guide bushing (9), and said support bearings (46).

13. Apparatus according to claim 12, including at least one balancing weight means (44) on said straightening rotor (4).

14. Apparatus according to claim 12, in which said straightening blocks of said group of straightening blocks (5, 6, 7) each have the same longitudinal length, and said straightening blocks consecutively spaced along said longitudinal axis (25) by a distance less than the longitudinal length of one said straightening blocks.

15. Apparatus according to claim 14, in which said group of straightening blocks comprise only three straightening blocks (5, 6, 7), and said guide bushing (9) comprises two guide bushings (9) and said three straightening blocks (5, 6, 7) are positioned between said two guide bushings (9).

16. Apparatus according to claim 15, in which the straightening rotor (4) provides three wire deflection points, one straightening block (5, 6, 7) of said three straightening blocks positioned at each of said wire deflection points, each straightening block having a groove (31), the depth of which corresponds at least to the wire diameter, and a sliding surface (47) in said groove, the groove (31) of each straightening block oriented away from said longitudinal axis (25); two headless screws (40, 41) connecting each straightening block to said straightening rotor in selected radial position, wherein the headless screw (40) adjacent the sliding surface having a smooth end surface facing the sliding surface (47).

17. Apparatus according to claim 16, in which the width of the groove (31) of each straightening block (5, 6, 7) is greater by a tolerance than the diameter of the wire, the groove (31) of each straightening block having an open side and parallel side wall portions, said straightening block having a pair of parallel side walls (33) parallel with said parallel side wall portions of the groove (31) defining therebetween the thickness of said pair of parallel side walls (33) at the open side of the groove as being in the range of one-third of the width of the groove (31).

18. Apparatus according to claim 10, in which said driving means (48, 50–52, 54 and 56–58) includes a motor, gearing connected to said motor, and belt drive means connected between said gearing and said straightening rotor, and between said gearing and said conveying means, whereby said straightening rotor and conveying means are synchronously accelerated and decelerated by said motor.

* * * * *